US010710107B2

(12) United States Patent
Sokolowski

(10) Patent No.: US 10,710,107 B2
(45) Date of Patent: Jul. 14, 2020

(54) FILLING APPARATUS FOR HERMETICALLY SEALED BOTTLES

(71) Applicant: Andrzej Sokolowski, Weingarten (DE)

(72) Inventor: Andrzej Sokolowski, Weingarten (DE)

( * ) Notice: Subject to any disclaimer, the term of this patent is extended or adjusted under 35 U.S.C. 154(b) by 0 days.

(21) Appl. No.: 16/274,630

(22) Filed: Feb. 13, 2019

(65) Prior Publication Data

US 2019/0255546 A1 Aug. 22, 2019

(30) Foreign Application Priority Data

Feb. 22, 2018 (DE) ..... 10 2018 001 411

(51) Int. Cl.

| | |
|---|---|
| ***B67D 7/72*** | (2010.01) |
| ***B05B 9/04*** | (2006.01) |
| ***B05B 11/00*** | (2006.01) |
| ***B67D 7/02*** | (2010.01) |

(52) U.S. Cl.

CPC ..... *B05B 11/0056* (2013.01); *B05B 9/0426* (2013.01); *B05B 11/0097* (2013.01); *B67D 7/0205* (2013.01); *B67D 7/72* (2013.01)

(58) Field of Classification Search

CPC ..... B05B 11/0056; B05B 11/0097; B05B 9/0426; B67D 7/0205; B67D 7/72

See application file for complete search history.

(56) References Cited

U.S. PATENT DOCUMENTS

| | | | | |
|---|---|---|---|---|
| 5,524,680 | A | 6/1996 | de Laforcade | |
| 2012/0158193 | A1* | 6/2012 | De Rosa | A47K 5/1217 700/283 |

* cited by examiner

*Primary Examiner* — Timothy L Maust
*Assistant Examiner* — Jason K Niesz
(74) *Attorney, Agent, or Firm* — Bachman & LaPointe, P.C.

(57) ABSTRACT

A filling apparatus (110, 210) for a hermetically sealed bottle (200) is created by means of a dual bottle adapter (210), at least indirectly connected to the bottle (200), for an input of liquid from a storage container (100) provided with a dual container adapter (110) and at least partially filled with liquid, wherein between a liquid exit port (111) of the dual container adapter (110) and a liquid entry port (211) of the dual bottle adapter (210) a sealed-off liquid communication connection is present, and between a gas entry port (112) of the dual container adapter (110) and a gas exit port (212) of the dual bottle adapter (210) a sealed-off gas communication connection is present.

14 Claims, 4 Drawing Sheets

FILLING APPARATUS FOR HERMETICALLY SEALED BOTTLES

CROSS-REFERENCE TO RELATED APPLICATION

Priority is claimed of DE 10 2018 001 411.9, filed Feb. 22, 2018, the disclosure of which is incorporated by reference herein in its entirety as if set forth at length.

BACKGROUND OF THE INVENTION

The invention relates to a filling apparatus for a filling process of a hermetically sealed bottle.

Filling apparatuses for open bottles are known in various forms in the prior art. Filling apparatuses of the type stated in the introduction are not known to the Applicant.

SUMMARY OF THE INVENTION

The object of the invention is therefore to provide a filling apparatus for sealed bottles.

For a filling apparatus of the type stated in the introduction, this object is achieved according to the invention by means of a dual bottle adapter, at least indirectly connected to the bottle, for an input of liquid from a storage container provided with a dual container adapter and at least partially filled with liquid, wherein between a liquid exit port of the dual container adapter and a liquid entry port of the dual bottle adapter is provided a sealed-off liquid communication connection, and between a gas entry port of the dual container adapter and a gas exit port of the dual bottle adapter is provided a sealed-off gas communication connection.

Preferred embodiments of the invention are the subject of the subclaims, the elements of which act to further improve the approach to achieving the object underlying the invention.

In the filling apparatus according to the invention, with the aid of the provision of a dual bottle adapter, at least indirectly connected to the bottle, for an input of liquid from a storage container provided with a dual container adapter and at least partially filled with liquid, wherein between a liquid exit port of the dual container adapter and a liquid entry port of the dual bottle adapter is provided a sealed-off liquid communication connection, and between a gas entry port of the dual container adapter and a gas exit port of the dual bottle adapter is provided a sealed-off gas communication connection, a filling process of a sealed bottle is enabled by virtue of the fact that a discharge of gas or air from the bottle takes place to the extent in which an input of liquid is realized, wherein the discharged gas or the discharged air is passed into the storage container, and thus a quantitively corresponding input of gas or air into the storage container is realized, in which, in turn, a quantitively corresponding liquid discharge takes place.

According to a first preferred embodiment of the filling apparatus according to the invention, it is provided that the liquid exit port and the gas entry port of the dual container adapter are respectively configured as pipe end pieces with predefined outer diameter of a robust mechanical unit configured as an adapter body.

Furthermore, the liquid exit port of the dual container adapter is preferably disposed within a robust mechanical unit, configured as an adapter body, at predefined distance from the gas entry port of the dual container adapter.

Concerning the dual bottle adapter, the relevant the liquid entry port and the gas exit port are preferably configured as bores which are made in a robust adapter block and the respective inner diameters of which, for the purpose of enabling a sealed-off plug-in connection, are matched to the predefined outer diameter of the liquid exit port and of the gas entry port of the dual container adapter.

In addition, the liquid entry port of the dual bottle adapter is preferably disposed within a robust mechanical unit, configured as an adapter block, at predefined distance from the gas exit port of the dual bottle adapter.

As stated above, the adapter block of the bottle adapter and the adapter body of the container adapter can be mutually matched in terms of their dimensions and their shaping in order to enable a direct, detachably fixed plug-in connection between bottle adapter and container adapter.

Alternatively to a direct plug-in connection, an indirect, detachably fixed plug-in connection of the adapter block of the bottle adapter to the adapter body of the container adapter can be formed by, on the one hand, configuring a liquid communication connection between the bottle adapter and the container adapter as a first sealed-off flexible hose and, on the other hand, configuring a gas communication connection between the container adapter and the bottle adapter as a second gastight flexible hose. The inner diameter of the first hose can here be dimensioned larger than the inner diameter of the second hose.

According to an important preferred embodiment of the filling apparatus according to the invention, a pump is present in order to pump liquid out of the storage container into the bottle.

The pump is here preferably configured as a hollow cylinder provided, in the region of its closed lower end face, with a nonreturn valve, in the open upper end face of which is inserted a piston connected to a piston rod, which piston is reciprocatingly mounted in the hollow cylinder, wherein a bore directed through the piston and the piston rod forms a liquid communication connection from the inside of the container to the container adapter, and a gas communication connection configured as a hose leads from the container adapter into the inside of the container.

Furthermore, a helical spring, one end of which is supported in the region of the surface of the storage container and the other end of which adjoins a stop attached to the piston rod, is preferably provided in order to return the piston rod and hence the piston, subsequent to a transfer of the piston from a neutral rest position in the direction toward the closed end face of the hollow cylinder, within a pumping process, into the neutral rest position.

According to another preferred embodiment of the filling apparatus according to the invention, the container adapter is disposed in the region of an upper end face of the piston rod, and the bottle adapter is disposed in the region of a base of the bottle, or the piston rod is reciprocatingly mounted in the hollow cylinder by means of a gripping element attached to that end of the piston rod which is remote from the piston, wherein the container adapter is configured in an upper lateral region of the piston rod between the gripping element and the stop. In this case, the bottle adapter is preferably disposed in the region of a side wall of the bottle or in the region of a spraying attachment of the bottle.

According to a further important preferred embodiment of the filling apparatus according to the invention, the adapter bodies of container adapters of storage containers filled with different liquid contents, for the purpose of a clear allocation of container adapter to liquid content contained in relevant storage container, are designed differently in terms of their dimensioning and/or shaping.

BRIEF DESCRIPTION OF THE DRAWINGS

The filling apparatus according to the invention is explained below with reference to a preferred embodiment, which are represented in the figures of the drawings, in which.

DETAILED DESCRIPTION

Figure 1:
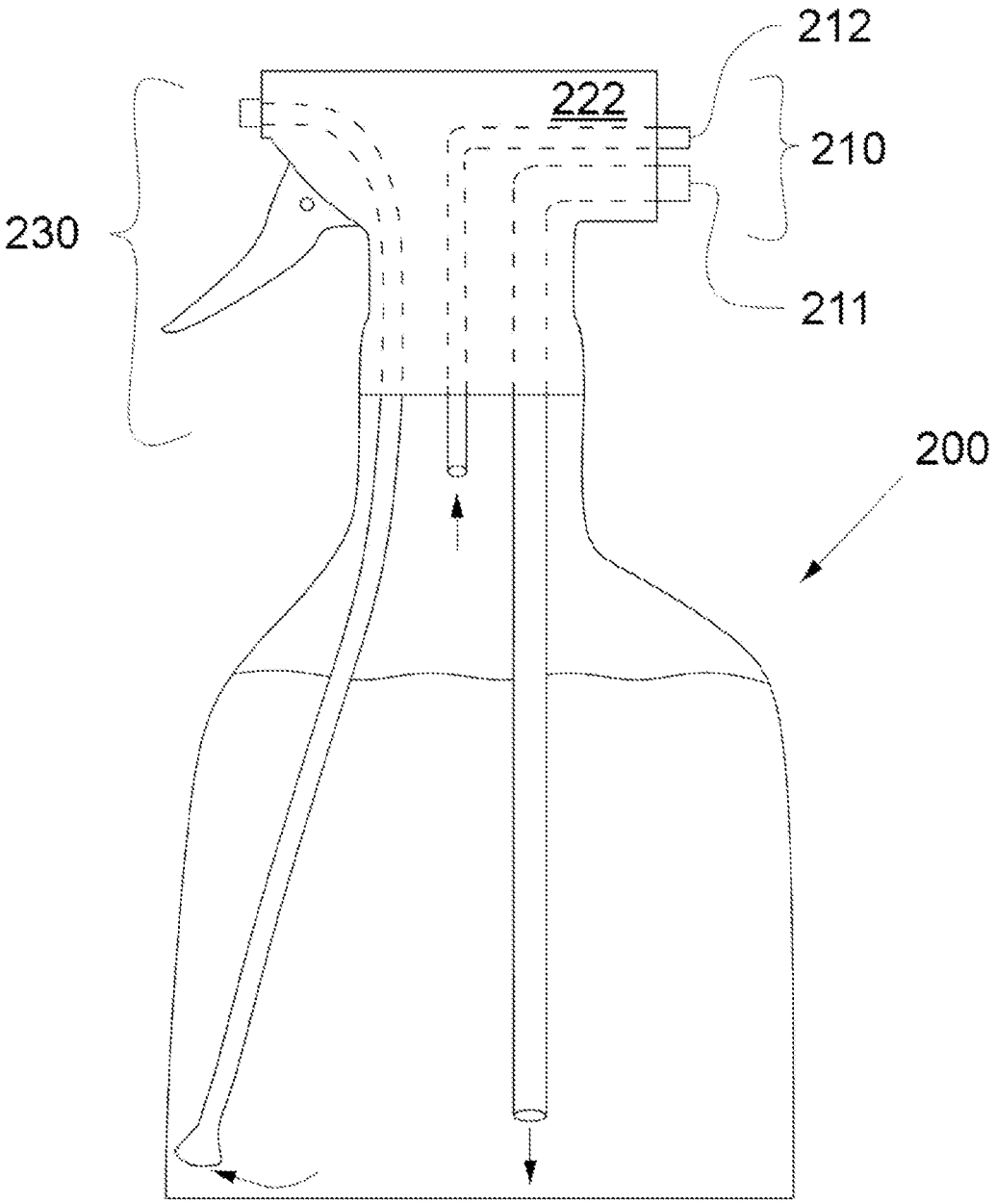
FIG. 1 shows a first preferred embodiment of the filling apparatus according to the invention in a schematic cross-sectional view.

The filling apparatuses 110, 210 according to the invention which are represented in FIGS. 1 to 4 are intended for filling a hermetically sealed bottle 200 and contain a dual bottle adapter 210, at least indirectly connected to the bottle 200, for an input of liquid from a storage container 100 provided with a dual container adapter 110 and at least partially filled with liquid, wherein between a liquid exit port 111 of the dual container adapter 110 and a liquid entry port 211 of the dual bottle adapter 210 is provided a sealed-off liquid communication connection, and between a gas entry port 112 of the dual container adapter 110 and a gas exit port 212 of the dual bottle adapter 210 is provided a sealed-off gas communication connection.

The liquid exit port 111 and the gas entry port 112 of the dual container adapter 110 are respectively configured as pipe end pieces with predefined outer diameter of a robust mechanical unit configured as an adapter body 120.

The liquid exit port 111 of the dual container adapter 110 is disposed within a robust mechanical unit, configured as an adapter body 120, at predefined distance from the gas entry port 112 of the dual container adapter 110.

The liquid entry port 211 and the gas exit port 212 of the dual bottle adapter 210 are configured as bores made in an adapter block 220, the respective inner diameters of which, for the purpose of enabling a sealed-off plug-in connection, are matched to the predefined outer diameter of the liquid exit port 111 and gas entry port 112 of the dual container adapter 110.

The liquid entry port 211 of the dual bottle adapter 210 is disposed within a robust mechanical unit, configured as an adapter block 220, at predefined distance from the gas exit port 212 of the dual bottle adapter 210.

The adapter block 220 of the bottle adapter 210 and the adapter body 120 of the container adapter 110 are mutually matched in terms of their dimensions and their shaping in order to enable a direct, detachably fixed plug-in connection between bottle adapter 210 and container adapter 110. The inner diameter of the first hose is here dimensioned larger than the inner diameter of the second hose.

A pump 130 is provided in order to pump liquid out of the storage container 100 into the bottle 200. The pump 130 is configured as a hollow cylinder 133 provided in the region of its closed lower end face 131 with a non-return valve 132, in the open upper end face 134 of which is inserted a piston 140 connected to a piston rod 141, which piston is reciprocatingly mounted in the hollow cylinder 133, wherein a bore 142 directed through the piston 140 and the piston rod 141 forms a liquid communication connection from the inside of the container 100 to the container adapter 110, and a gas communication connection, configured as a hose 143, leads from the container adapter 110 into the inside of the container 100.

A helical spring 135 is provided, one end 136 of which is supported in the region of the surface 116 of the storage container 100 and the other end 137 of which adjoins a stop 144 attached to the piston rod 141 in order to return the piston rod 141 and hence the piston 140, subsequent to a transfer of the piston 140 from a neutral rest position, in the direction toward the closed end face 131 of the hollow cylinder 133, within a pumping process, into the neutral rest position.

In the embodiment represented in FIG. 1, the container adapter 110 is disposed in the region of an upper end face 145 of the piston rod 141, and the bottle adapter 210 in the region of a base 201 of the bottle 200.

Figure 2:
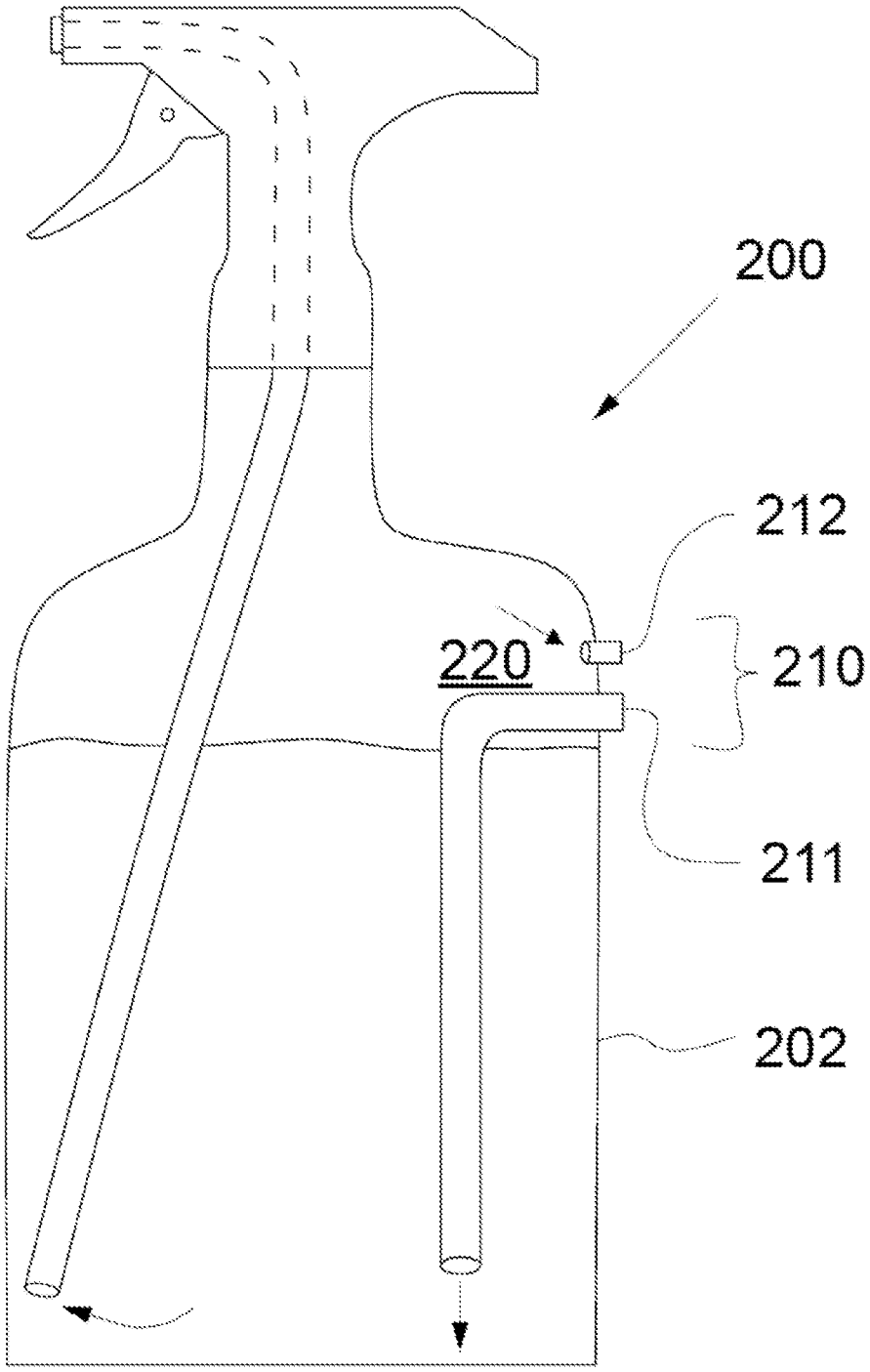
FIG. 2 shows another preferred embodiment of the filling apparatus according to the invention in a schematic cross-sectional view.

In the embodiment represented in FIG. 2, the piston rod 141, by means of a gripping element 150 attached to that end of the piston rod 141 which is remote from the piston 140, is mounted reciprocatingly in the hollow cylinder 133, and the container adapter 110 is configured in an upper lateral region of the piston rod 141 between the gripping element 150 and the stop 144.

Figure 3:
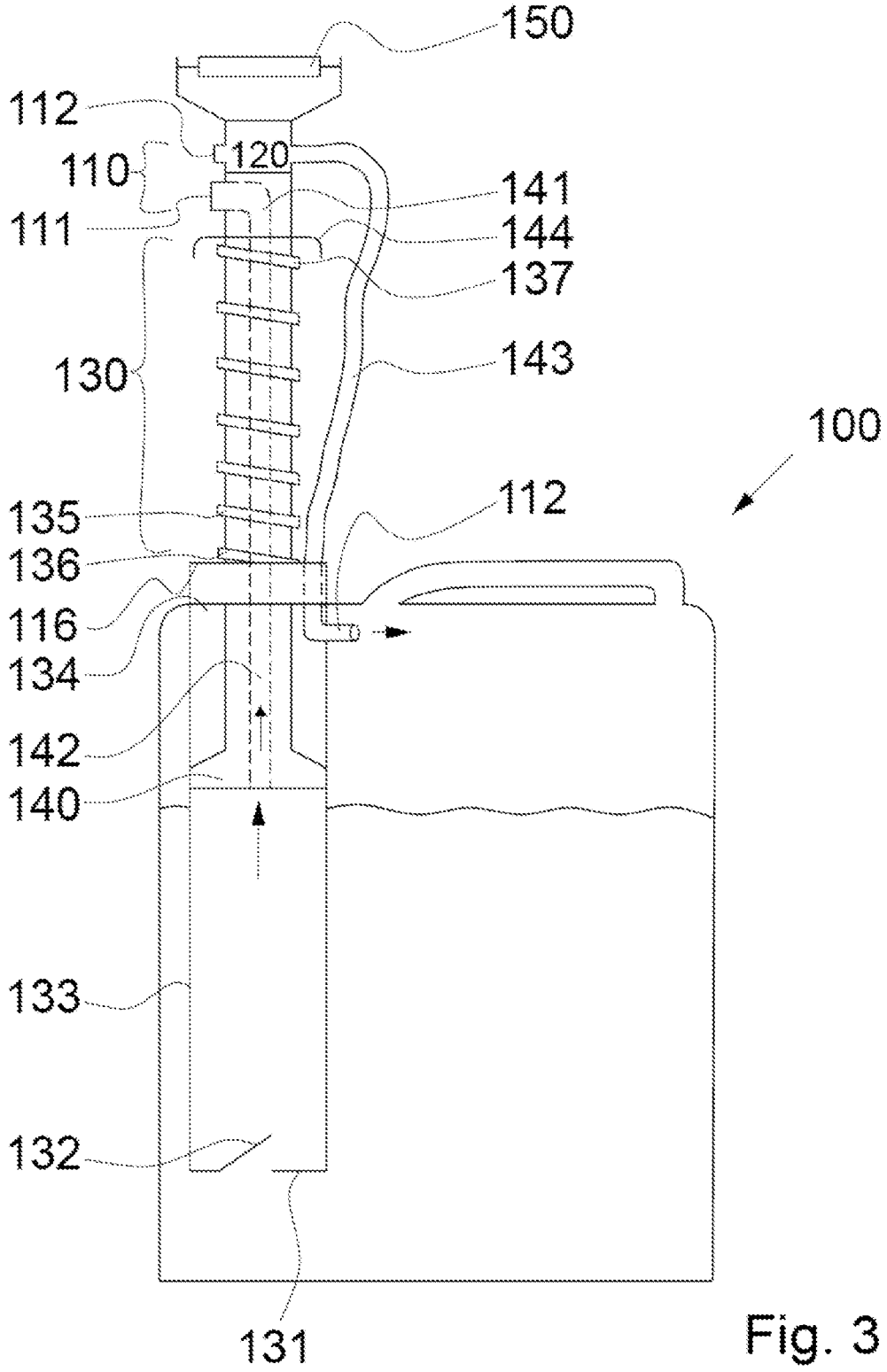
FIG. 3 shows another preferred embodiment of the filling apparatus according to the invention in a schematic cross-sectional view.

According to the embodiment represented in FIG. 3, the bottle adapter 210 is disposed in the region of a side wall 202 of the bottle 200.

Figure 4:
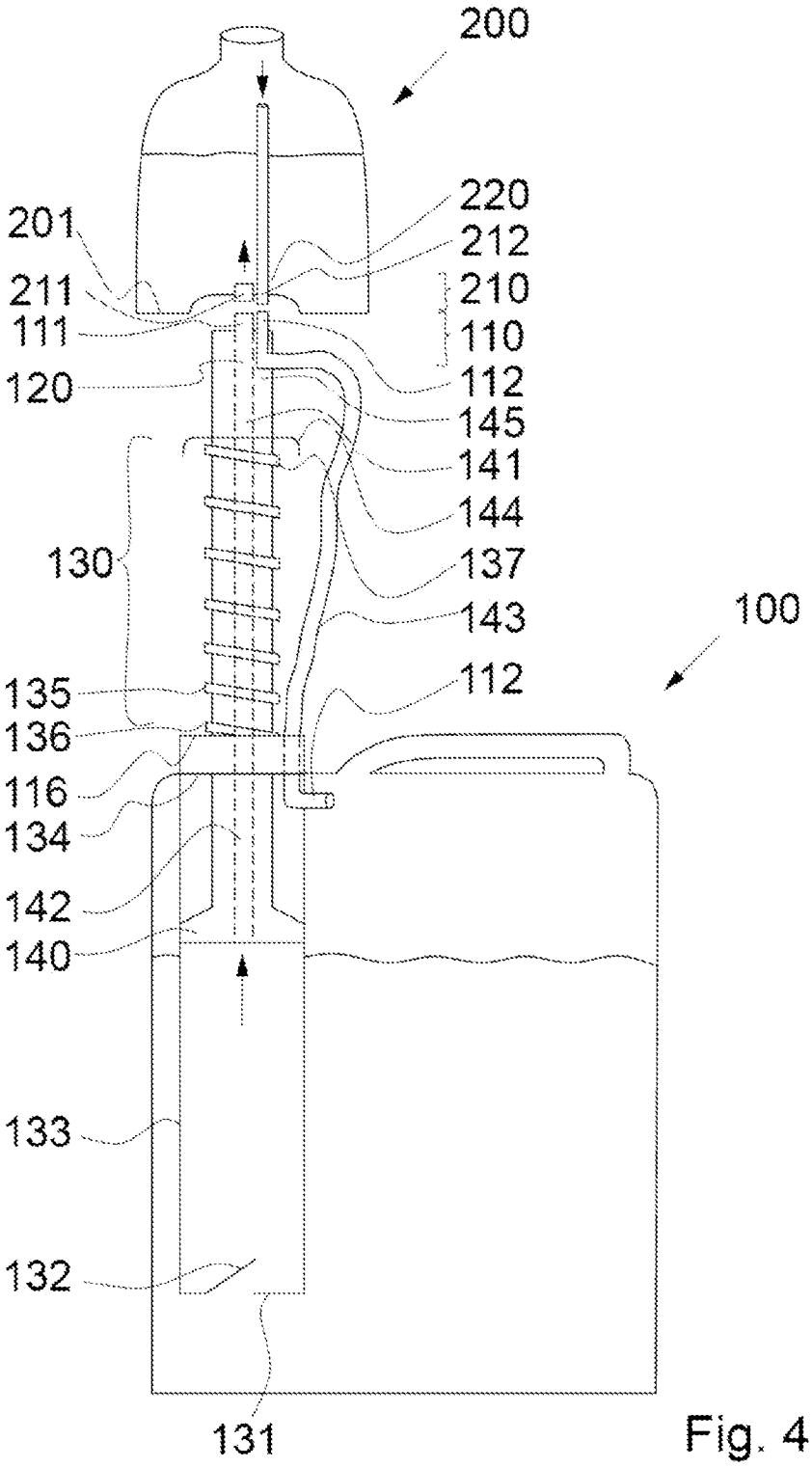
FIG. 4 shows another preferred embodiment of the filling apparatus according to the invention in a schematic cross-sectional view.

According to the embodiment represented in FIG. 4, the bottle adapter 210 is disposed in the region of a spraying attachment 230 of the bottle 200.

The above-described illustrative embodiment of the invention serves merely for the purpose of a better understanding of the teaching according to the invention, which is predefined by the claims and which, as such, is not restricted by the illustrative embodiment.

REFERENCE SYMBOL LIST

100 storage container
110, 210 filling apparatus
110 container adapter
111 liquid exit port
112 gas entry port
116 surface
120 adapter body
130 pump
131 closed lower end face
132 nonreturn valve
133 hollow cylinder
134 open upper end face
135 helical spring
136 one end
137 other end
140 piston
141 piston rod
142 bore
143 hose
144 stop
145 upper end face of the piston rod
150 gripping element
200 bottle
201 base of the bottle

202 side wall of the bottle
210 bottle adapter
211 liquid entry port
212 gas exit port
220 adapter block
230 spraying attachment

What is claimed is:

1. Filling apparatus (110, 210) for a hermetically sealed bottle (200), the apparatus comprising:

a dual bottle adapter (210), at least indirectly connected to the bottle (200), for an input of liquid from a storage container (100) provided with a dual container adapter (110) and at least partially filled with liquid, wherein between a liquid exit port (111) of the dual container adapter (110) and a liquid entry port (211) of the dual bottle adapter (210) is provided a sealed-off liquid communication connection, and between a gas entry port (112) of the dual container adapter (110) and a gas exit port (212) of the dual bottle adapter (210) is provided a sealed-off gas communication connection; and a pump (130) to pump liquid out of the storage container (100) into the bottle (200), wherein the pump (130) is configured as a hollow cylinder (133) provided, in the region of a closed lower end face (131), with a nonreturn valve (132), in the open upper end face (134) of which is inserted a piston (140) connected to a piston rod (141), which piston is reciprocatingly mounted in the hollow cylinder (133), wherein a bore (142) directed through the piston (140) and the piston rod (141) forms a liquid communication connection from the inside of the container (100) to the container adapter (110), and a gas communication connection configured as a hose (143) leads from the container adapter (110) into the inside of the container (100).

2. Filling apparatus (110, 210) according to claim 1, characterized in that the liquid exit port (111) and the gas entry port (112) of the dual container adapter (110) are respectively configured as pipe end pieces of an adapter body (120).

3. Filling apparatus (110, 210) according to claim 1, characterized in that the liquid exit port (111) of the dual container adapter (110) is disposed within an adapter body (120), said liquid exit port (111) at a predefined distance from the gas entry port (112) of the dual container adapter (110).

4. Filling apparatus (110, 210) according to claim 3, characterized in that the liquid entry port (211) and the gas exit port (212) of the dual bottle adapter (210) are configured as bores which are made in an adapter block (220) and the respective inner diameters of which, for the purpose of enabling a sealed-off plug-in connection, are matched to the predefined outer diameter of the liquid exit port (111) and of the gas entry port (112) of the dual container adapter (110).

5. Filling apparatus (110, 210) according to claim 1, characterized in that the liquid entry port (211) of the dual bottle adapter (210) is disposed within an adapter block (220), said liquid entry port (211) at a predefined distance from the gas exit port (212) of the dual bottle adapter (210).

6. Filling apparatus (110, 210) according to claim 5, characterized in that the adapter block (220) of the bottle adapter (210) and the adapter body (120) of the container adapter (110) are mutually matched in terms of their dimensions and their shaping in order to enable a direct, detachably fixed plug-in connection between bottle adapter (210) and container adapter (110).

7. Filling apparatus (110, 210) according to claim 1, characterized in that an indirect, detachably fixed plug-in connection of the adapter block (220) of the bottle adapter (210) to the adapter body (120) of the container adapter (110) is created by, on the one hand, configuring a liquid communication connection between the bottle adapter (210) and the container adapter (110) as a first sealed-off flexible hose and, on the other hand, configuring a gas communication connection between the container adapter (110) and the bottle adapter (210) as a second gastight flexible hose.

8. Filling apparatus (110, 210) according to claim 7, characterized in that the inner diameter of the first hose is dimensioned larger than the inner diameter of the second hose.

9. Filling apparatus (110, 210) according to claim 1, characterized in that a helical spring (135), one end (136) of which is supported in the region of the surface (116) of the storage container (100) and the other end (137) of which adjoins a stop (144) attached to the piston rod (141), is provided in order to return the piston rod (141) and hence the piston (140), subsequent to a transfer of the piston (140) from a neutral rest position in the direction toward the closed end face (131) of the hollow cylinder (133), within a pumping process, into the neutral rest position.

10. Filling apparatus (110, 210) according to claim 1, characterized in that the container adapter (110) is disposed in the region of an upper end face (145) of the piston rod (141), and the bottle adapter (210) is disposed in the region of a base (201) of the bottle (200).

11. Filling apparatus (110, 210) according to claim 1, characterized in that the piston rod (141) is reciprocatingly mounted in the hollow cylinder (133) by means of a gripping element (150) attached to that end of the piston rod (141) which is remote from the piston (140), and the container adapter (110) is configured in an upper lateral region of the piston rod (141) between the gripping element (150) and the stop (144).

12. Filling apparatus (110, 210) according to claim 11, characterized in that the bottle adapter (210) is disposed in the region of a side wall (202) of the bottle (200).

13. Filling apparatus (110, 210) according to claim 11, characterized in that the bottle adapter (210) is disposed in the region of a spraying attachment (230) of the bottle (200).

14. Filling apparatus (110, 210) according to claim 13, characterized in that the adapter body (120) of container adapters (110) of containers (100) with different liquid content, for the purpose of a clear allocation of container adapter (110) to liquid content, are designed differently in terms of their dimensioning and/or shaping.

* * * * *